US009648955B2

(12) United States Patent
Su

(10) Patent No.: US 9,648,955 B2
(45) Date of Patent: May 16, 2017

(54) CHAIR BACK ELEVATION ADJUSTMENT STRUCTURE

(71) Applicant: Chih-Cheng Su, Dongguan (CN)

(72) Inventor: Chih-Cheng Su, Dongguan (CN)

(73) Assignee: DONGGUAN KENTEC OFFICE SEATING CO., LTD., Dongguan (CN)

( * ) Notice: Subject to any disclaimer, the term of this patent is extended or adjusted under 35 U.S.C. 154(b) by 45 days.

(21) Appl. No.: 14/816,011

(22) Filed: Aug. 2, 2015

(65) Prior Publication Data

US 2017/0027328 A1 Feb. 2, 2017

(51) Int. Cl.

| | |
|---|---|
| ***B60N 2/02*** | (2006.01) |
| ***B60N 2/30*** | (2006.01) |
| ***A47C 7/40*** | (2006.01) |
| *A47C 1/032* | (2006.01) |
| *A47C 1/024* | (2006.01) |

(52) U.S. Cl.
CPC ..... *A47C 7/402* (2013.01); *A47C 7/40* (2013.01); *A47C 1/024* (2013.01); *A47C 1/03238* (2013.01); *A47C 1/03255* (2013.01)

(58) Field of Classification Search
CPC ..... A47C 7/40; A47C 7/402; A47C 1/024; A47C 1/03255; A47C 1/03238
USPC ..... 297/353, 300.1, 300.2, 357, 463.1; 248/157, 161, 407, 408
See application file for complete search history.

(56) References Cited

U.S. PATENT DOCUMENTS 5,765,920 A * 6/1998 Lai ..... A47C 1/03 248/297.31
6,299,253 B1 * 10/2001 Chen ..... A47C 7/402 297/353
6,631,953 B2 * 10/2003 Lai ..... A47C 7/402 297/353
7,243,997 B1 * 7/2007 Tornero ..... A47C 1/03 297/383
7,360,837 B1 * 4/2008 Liu ..... A47C 7/402 297/353
7,775,593 B2 * 8/2010 Hu ..... A47C 7/402 297/353
8,020,934 B2 * 9/2011 Hu ..... A47C 7/402 297/353
8,128,309 B2 * 3/2012 Tsai ..... A47C 7/402 297/411.36
2003/0057756 A1 * 3/2003 Lai ..... A47C 7/402 297/353
2006/0202529 A1 * 9/2006 Johnson ..... A47C 1/023 297/286

* cited by examiner

*Primary Examiner* — Chi Q Nguyen

(57) ABSTRACT

The invention includes a frame, a back board and an adjustment set. The frame has a central trench and an adjustment board with limiting slots and two sliding slots. The back board is connected to the frame and has an opening. The adjustment set is connected between the frame and the back board and includes: a sliding seat having an engagement block received in the opening, and the engagement block having a recess with a through hole; a limiting body received in the recess, having a central bar in the through hole and an extending portion with a limiting bar in the limiting slots, and a C-shaped trench around the central bar; a torsion spring received in the C-shaped trench, two ends thereof protruding from the C-shaped trench and stopped by the recess; and two sliders received in the sliding slots. The sliders and the sliding seat are fixed to the back board.

10 Claims, 7 Drawing Sheets

CHAIR BACK ELEVATION ADJUSTMENT STRUCTURE

BACKGROUND OF THE INVENTION

1. Technical Field The invention relates to chairs, particularly to chair backs.

2. Related Art

Office chairs with a cushion elevation mechanism and/or flexible back have been very popular. Although many chairs are provided with a flexible back with tilt flexibility, height position of the back cannot be adjusted to satisfy various users with different body length. Even if few chairs offer an adjustable back, but its structure is too complicated and its cost is too high. Complexity, adjustability and reliability are very difficult to achieve a compromise.

SUMMARY OF THE INVENTION

An object of the invention is to provide a chair back elevation adjustment structure, which has great durability, accurately positioning effect and low cost.

To accomplish the above object, the invention includes a frame, a back board and an adjustment set. The frame has a central trench and an adjustment board with limiting slots and two sliding slots. The back board is connected to the frame and has an opening. The adjustment set is connected between the frame and the back board and includes: a sliding seat having an engagement block received in the opening, and the engagement block having a recess with a through hole; a limiting body received in the recess, having a central bar in the through hole and an extending portion with a limiting bar in the limiting slots, and a C-shaped trench around the central bar; a torsion spring received in the C-shaped trench, two ends thereof protruding from the C-shaped trench and stopped by the recess; and two sliders received in the sliding slots. The sliders and the sliding seat are fixed to the back board.

DETAILED DESCRIPTION OF THE INVENTION

Figure 1:
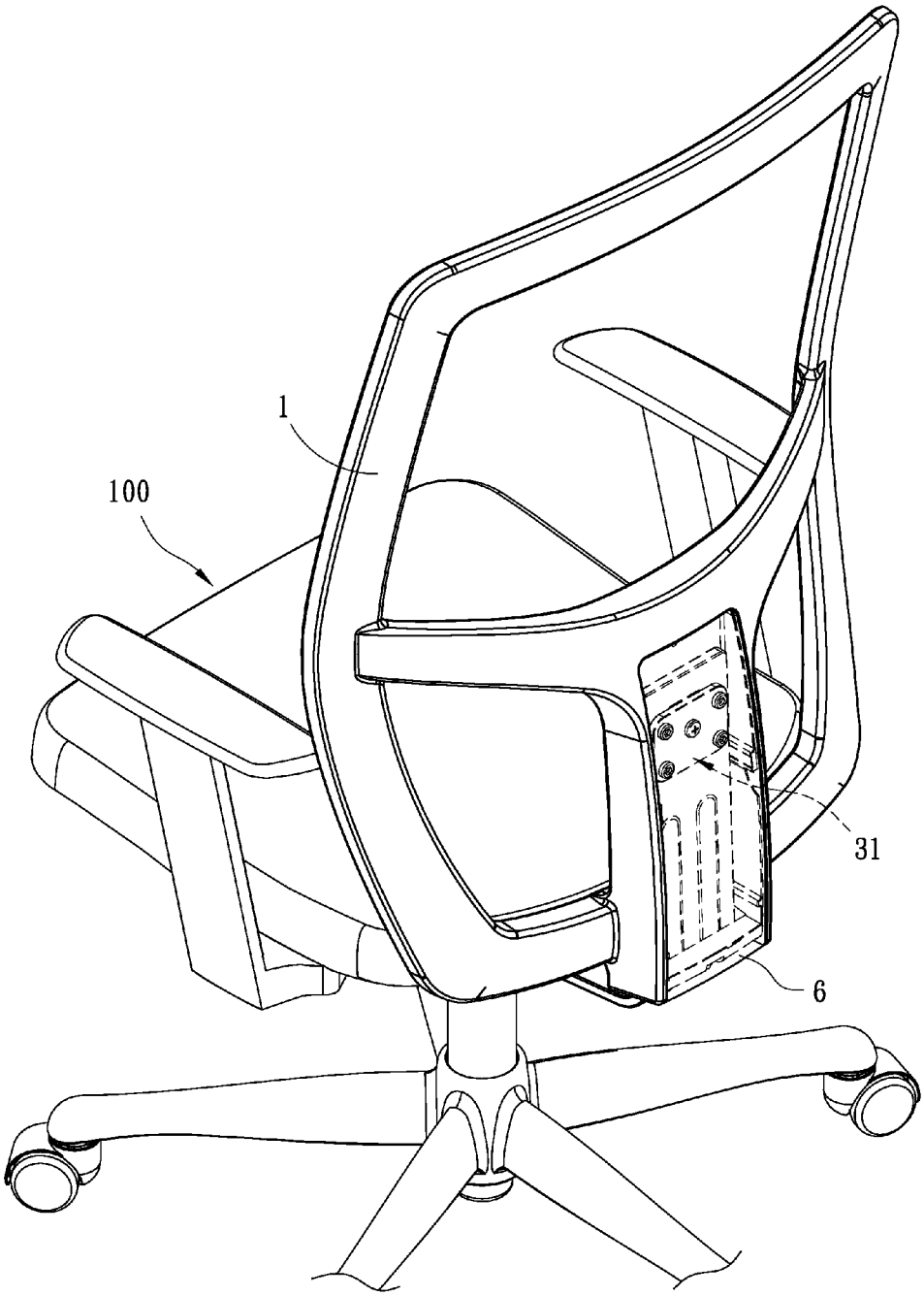
FIG. 1 is a schematic view of the invention used in a chair.
Figure 2:
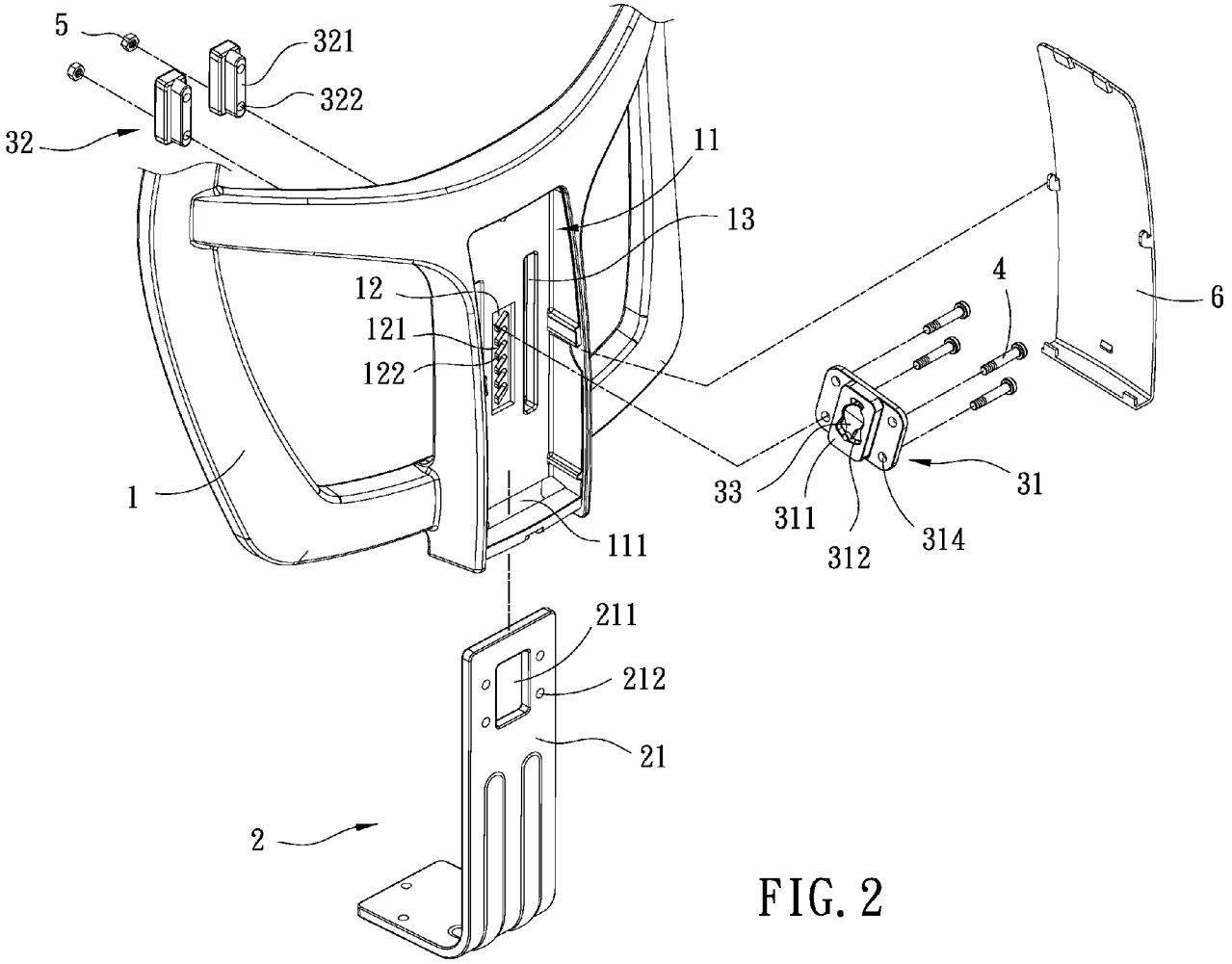
FIG. 2 is an exploded view of the invention.

Please refer to FIGS. 1 and 2. The chair back elevation adjustment structure of the invention is installed on a chair 100 as shown in FIG. 2. The adjustment structure includes a frame 1, a back board 2 and an adjustment set 3. The frame 1 is fastened to the chair 100 and is formed with a central trench 11. The bottom end of the central trench 11 is formed with a passing aperture 111. An adjustment board 12 is provided in a bed of the central trench 11. The adjustment board 12 is formed with a limiting channel 121 with limiting slots 122 arranged in a row. The limiting channel 121 is sawtooth-shaped. Two parallel sliding slots 13 are disposed beside the adjustment board 12. The back board 2 is connected to the frame 1 and is of an L-shape. The back board 2 has a connecting end 21 with an opening 211. The connecting end 21 is inserted into the passing aperture 111 to connect the back board 2 and the frame 1. In this embodiment, the opening 211 is rectangular in shape. The opening 211 corresponds to the adjustment board 12 in position. Fixing holes 212 are provided around the opening 211.

Figure 3:
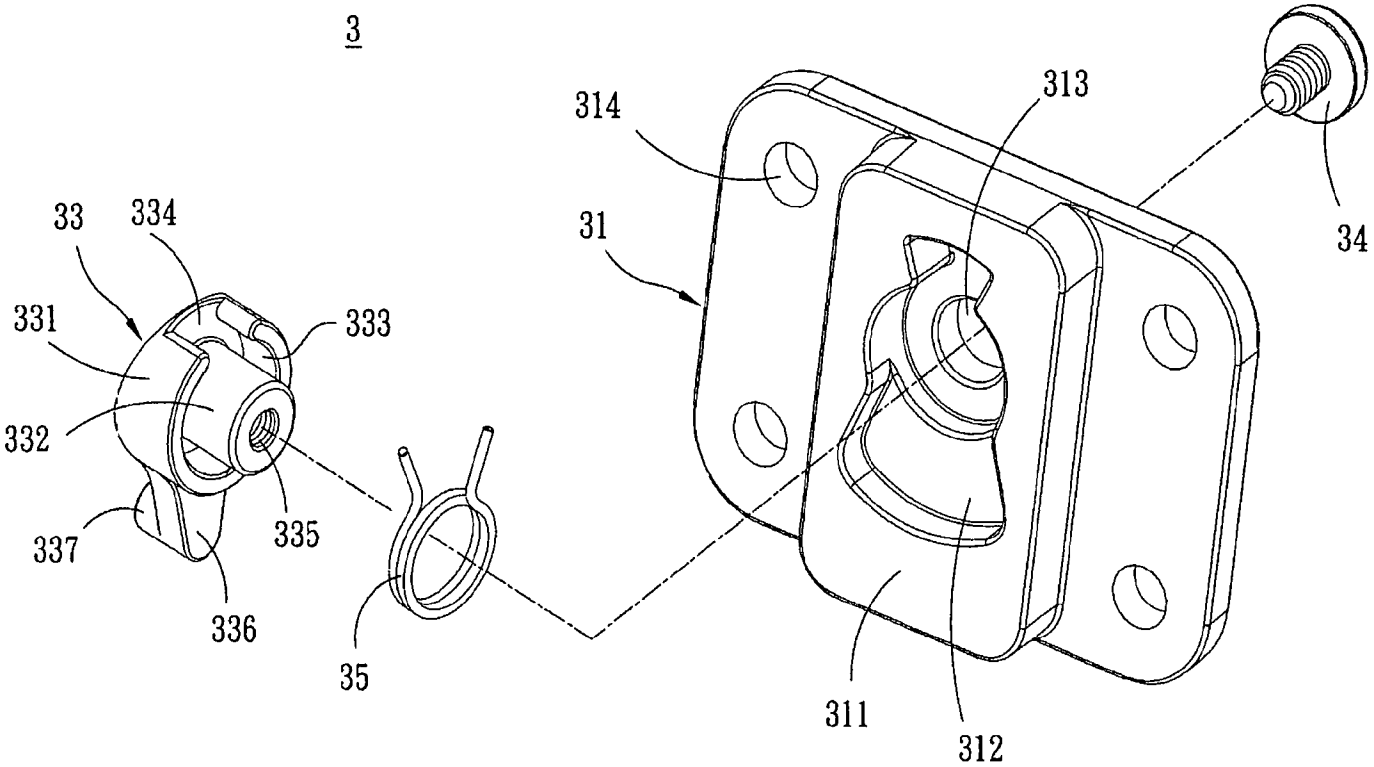
FIG. 3 is an enlarged view of the sliding seat and limiting body of the invention.

Please refer to FIG. 2. The adjustment set 3 is connected between the frame 1 and the back board 2 and includes a sliding seat 31 and two sliders 32. As shown in FIG. 3, the sliding seat 31 is a rectangular plate and is formed with an engagement block 311 on a side thereof. The engagement block 311 is a cuboid and is received in the opening 211 so as to connect the sliding seat 31 to the back board 2. The engagement block 311 has a recess 312 with a through hole 313. Four corners of the sliding seat 31 are separately formed with four passing holes 314. A limiting body 33 is received in the recess 312 and has a block 331 with a central bar 332 protruding therefrom. A C-shaped trench 333 is formed between the central bar 332 and a periphery of the block 331. The block 331 has a notch 334. The central bar 332 is inserted into the through hole 313. The top end of the central bar 332 is formed with a threaded hole 335 for being screwed by a bolt 34, so that the limiting body 33 can be fastened on the sliding seat 31. A torsion spring 35 is received in the C-shaped trench 333. Two ends of the torsion spring 35 protrude from the C-shaped trench 333 and are stopped by a periphery of the recess 312. An extending portion 336 protrudes from the block 331 and is formed with a limiting bar 337 received in the limiting channel 121.

Figure 4:
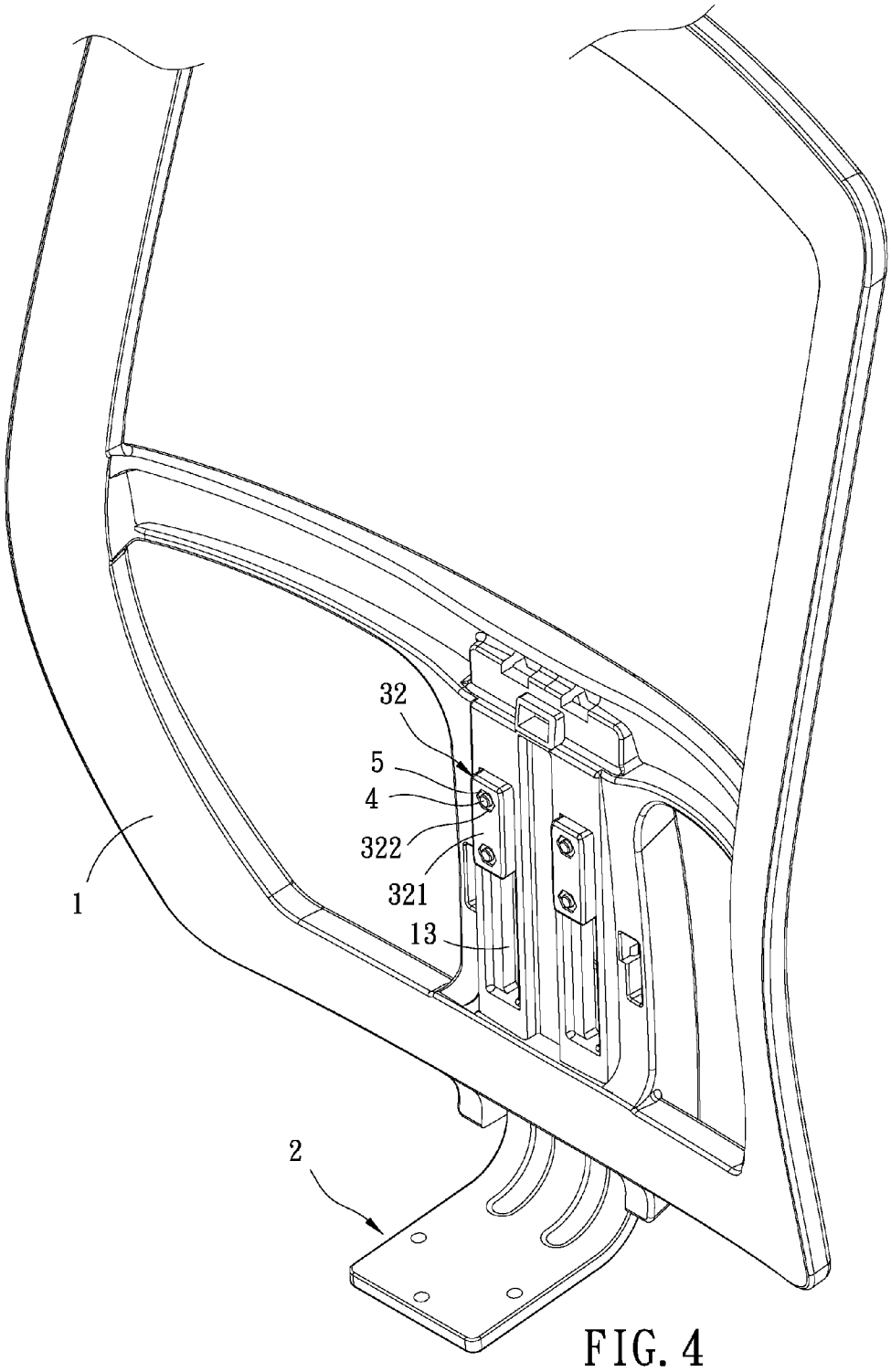
FIG. 4 is an assembled view of the invention.

Please refer back to FIG. 2. The two sliders 32 are located an inner side of the frame 1 and connected with the sliding seat 31. Further refer to FIG. 4. The sliders 32 are received in the sliding slots 13. Each of the sliders 32 is formed with a sliding block 321 received in one of the sliding slots 13. The sliding blocks 321 are formed with penetrating holes 322 which penetrate through the sliding blocks 321. The penetrating holes 322 align with the passing holes 314 and the fixing holes 212 for being separately passed through by bolts 4 with a nut 5, so that the sliders 32 and the sliding seat 31 are fixed to the back board 2. Finally, the central trench 11 is further provided with a cover 6.

Figure 5:
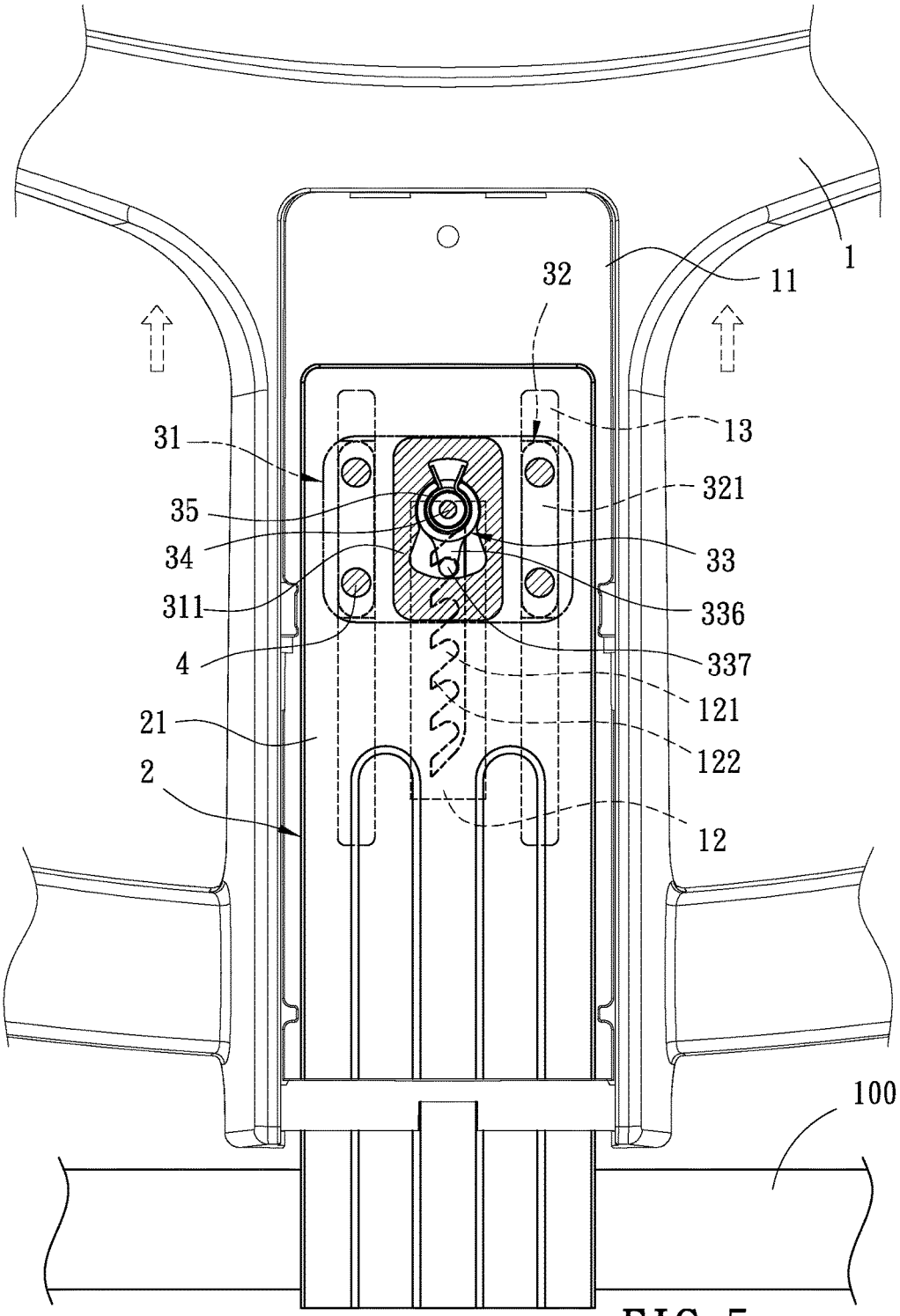
FIG. 5 is a schematic view showing operation of the invention.
Figure 6:
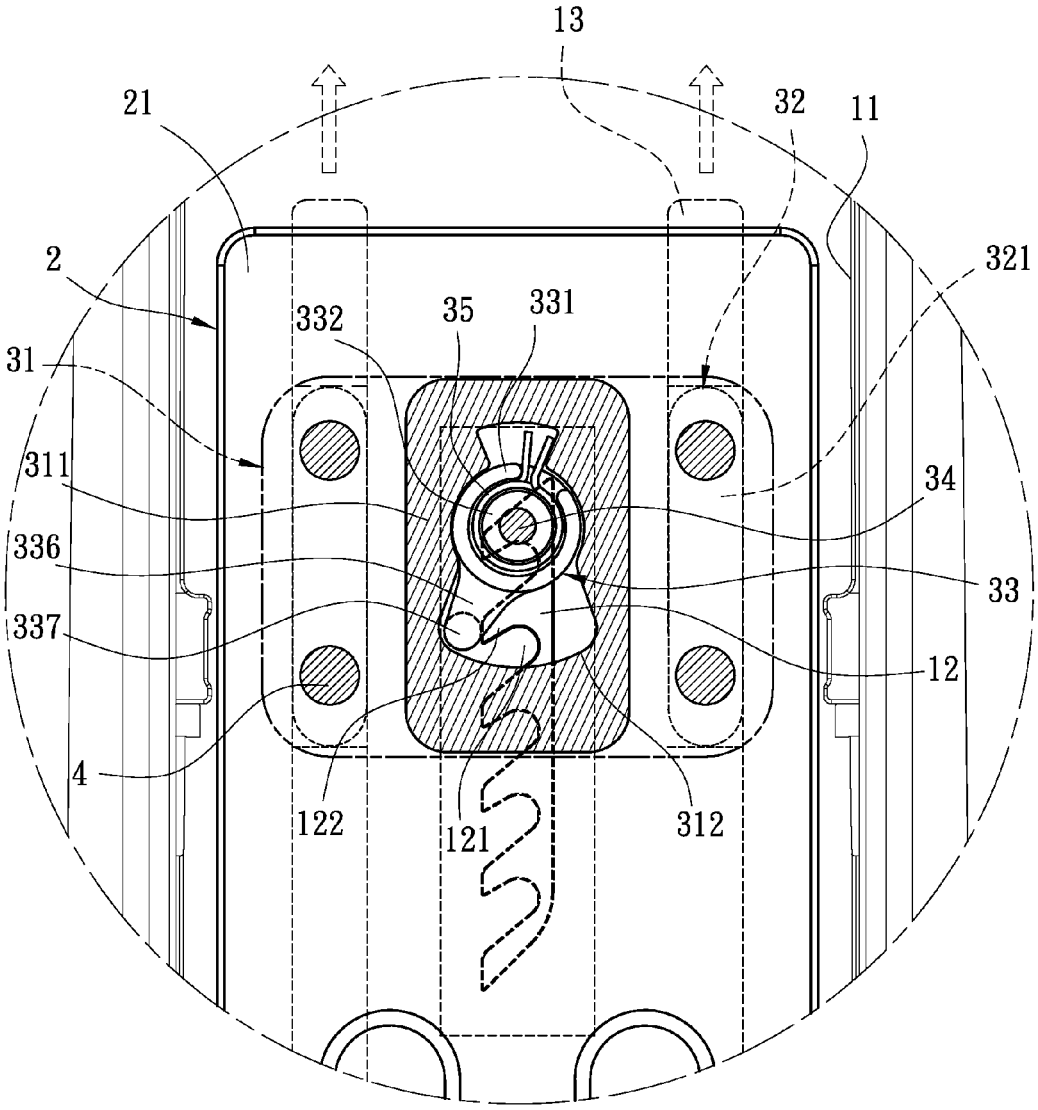
FIG. 6 is an enlarged view of FIG. 5.
Figure 7:
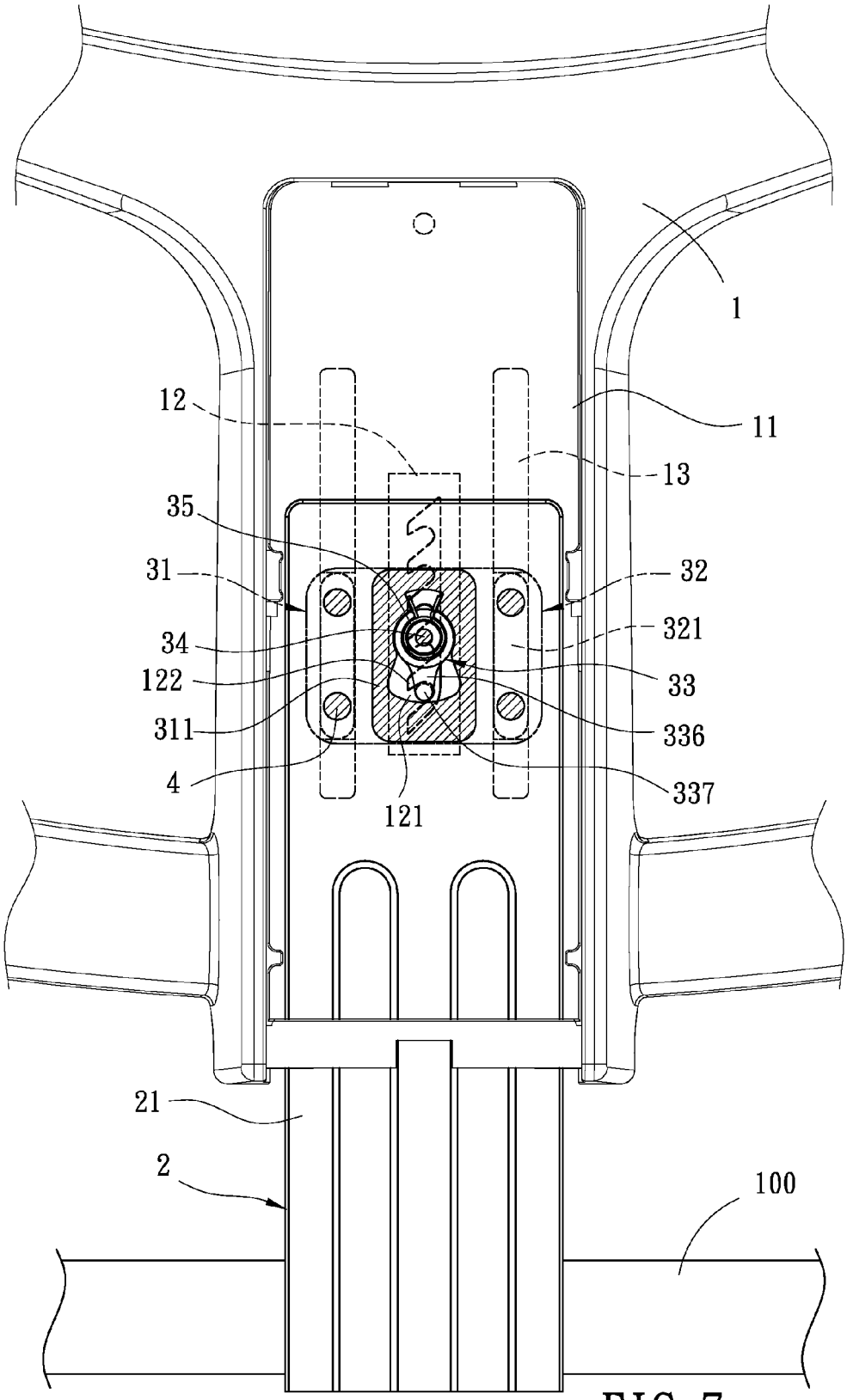
FIG. 7 is another schematic view showing operation of the invention.

Please refer to FIG. 5. The height of the frame 1 is held by the engagement of the limiting body 33 and the adjustment board 12. When the height needs to be adjusted, the back board 2 is fixed and the limiting channel 121 rotates the limiting body 33 while the frame 1 is being applied with a force as shown in FIG. 6. The torsion spring 35 is being compressed to generate a torque while the limiting body 33 is rotating. When the limiting body 33 moves in the limiting channel 121 to a limiting slot 122, the torque of the torsion spring 35 restores the limiting body 33 and the limiting bar 337 is embedded into the limiting slot to hold the height of the frame 1 as shown in FIG. 7. The height of the frame 1 can be still adjusted in this manner.

It will be appreciated by persons skilled in the art that the above embodiment has been described by way of example only and not in any limitative sense, and that various alterations and modifications are possible without departure from the scope of the invention as defined by the appended claims.

What is claimed is:

1. A chair back elevation adjustment structure comprising:

a frame, having a central trench and an adjustment board in a bottom of the central trench, the adjustment board having a limiting channel and two sliding slots beside the limiting channel, and the limiting channel having a plurality of limiting slots;

a back board, connected to the frame, having a connecting end with an opening corresponding to the adjustment board in position, and fixing holes being provided around the opening; and an adjustment set, connected between the frame and the back board, comprising:

a sliding seat, having passing holes and an engagement block received in the opening, and the engagement block having a recess with a through hole;

a limiting body, received in the recess, having a central bar inserted into the through hole and an extending portion with a limiting bar received in the limiting channel and one of the limiting slots, and a C-shaped trench being formed around the bar;

a torsion spring, received in the C-shaped trench, two ends of the torsion spring protruding from the C-shaped trench and stopped by a wall of the recess for restoring the limiting body;

two sliders, separately received in the sliding slots, having penetrating holes corresponding to the passing holes and the fixing holes in position; and bolts, separately passing through the penetrating holes, the passing holes and the fixing holes and screwing with a nut for fixing the sliders and the sliding seat onto the back board.

2. The chair back elevation adjustment structure of claim 1, wherein a bottom end of the central trench is formed with a passing aperture for being passed by the back board.

3. The chair back elevation adjustment structure of claim 1, wherein the limiting channel is sawtooth-shaped.

4. The chair back elevation adjustment structure of claim 1, wherein the back board is of an L-shape.

5. The chair back elevation adjustment structure of claim 1, wherein the opening is rectangular in shape.

6. The chair back elevation adjustment structure of claim 1, wherein the sliding seat is a rectangular plate.

7. The chair back elevation adjustment structure of claim 1, wherein the limiting body has a notch for allowing two ends of the torsion spring to protrude.

8. The chair back elevation adjustment structure of claim 1, wherein a top end of the central bar is formed with a threaded hole for being screwed by a bolt, so that the limiting body is fastened on the sliding seat.

9. The chair back elevation adjustment structure of claim 1, wherein each of the sliders is formed with a sliding block received in one of the sliding slots.

10. The chair back elevation adjustment structure of claim 1, wherein the central trench is cloaked by a cover.

* * * * *